United States Patent [19]

Depetris

[11] Patent Number: 4,968,017

[45] Date of Patent: Nov. 6, 1990

[54] METHOD AND DEVICE FOR FEEDING SIGNATURES ON TO A SEWING MACHINE

[75] Inventor: Lorenzo Depetris, Casale Monferrato, Italy

[73] Assignee: Smyth Europea Industrie S.p.A., Turin, Italy

[21] Appl. No.: 360,789

[22] Filed: Jun. 2, 1989

[30] Foreign Application Priority Data

Jun. 3, 1988 [IT] Italy ..... 67513 A/88
Mar. 16, 1989 [IT] Italy ..... 67187 A/89

[51] Int. Cl.[5] ..... B65H 5/02

[52] U.S. Cl. ..... 271/12; 271/225; 271/270; 271/271; 271/277; 271/202; 271/204; 271/146

[58] Field of Search ..... 271/12, 225, 233, 270, 271/271, 202, 204, 149, 150, 151, 146

[56] References Cited

U.S. PATENT DOCUMENTS 4,333,559 6/1982 Reist ..... 271/277 X
4,684,117 8/1987 Honegger ..... 271/270 X
4,747,817 5/1988 Newsome ..... 271/270 X

*Primary Examiner*—Richard A. Schacher
*Attorney, Agent, or Firm*—Klauber and Jackson

[57] ABSTRACT

A method and device for feeding signatures on to a fixed horizontal saddle of an input conveyor to a sewing machine; whereby the signatures, arranged with the backs facing rearwards, lying in respective vertical planes parallel to the fixed saddle, and separated by a distance of less than the maximum width of the signatures, are fed along a conveyor sloping downwards in the travelling direction of the input conveyor; the signatures being fed in an oblique direction in relation to the backs; each signature having a top corner projecting laterally from the stream of signatures travelling along the conveyor, which corner is engaged by a number of suction type parting heads located along, and moving reciprocatingly in the travelling direction of the signatures along the conveyor; and the signatures being so fed to an accelerating device designed to successively withdraw the signatures off the conveyor, and transfer the same, now parted, on to the fixed saddle; the parted front corner of each signature being guided, during transfer, by a fixed curved supporting plate, and being the first to engage the fixed saddle.

22 Claims, 11 Drawing Sheets

METHOD AND DEVICE FOR FEEDING SIGNATURES ON TO A SEWING MACHINE

BACKGROUND OF THE INVENTION

The present invention relates to a method for feeding signatures on to a sewing machine.

Book sewing machines generally present an input conveyor defined by a fixed, usually triangular-section saddle, the top edge of which presents a groove housing the top portion of a loop conveyor. This presents a number of equally-spaced pushers separated by a distance greater than the maximum signature length feedable on to the sewing machine. Each pusher moves upwards out of said groove, and acts as a push member for a respective signature lying astride the fixed saddle, with its back lying along the top edge of the same.

The signatures are fed successively on to the aforementioned input conveyor by means of a feeder usually comprising an input feedbox designed to accommodate a signature lot; a withdrawal assembly for withdrawing the signatures one by one from the feedbox; a "parting" conveyor system designed to successively receive and feed the signatures on to the sewing machine conveyor, prior to which, the signatures are successively engaged by a number of suction heads with suckers, for opening (to the center) the two halves of the signature; and an output feed assembly for receiving the signatures opened on the pusher conveyor, and successively feeding the same on to the fixed saddle of the sewing machine input conveyor.

As regards location of the pusher conveyor in relation to the fixed saddle on the sewing machine input conveyor, two feed device configurations are generally employed: one wherein the transport conveyor is located in line with the input saddle, and the other having a transport conveyor extending substantially crosswise in relation to the saddle.

With an in-line feed device configuration, the assembly consisting of the feeder and sewing machine presents a straight, relatively long structure, which poses numerous problems in terms of operation and floor space. Such a machine, in fact, not only demands extensive floor space, but, being usually run by one operator, involves a good deal of legwork, which often precludes immediate action in the event of malfunctioning.

With a transverse feeder configuration, on the other hand, the feeder-sewing machine assembly presents a substantially L-shaped, far more compact structure, better suited to single-operator control, by reducing the walking distance between the feeder and sewing machine, and so simplifying operation and enabling immediate action in the event of malfunctioning.

The technical scope of the present invention relates to feeders of the second, i.e. transverse configuration, type.

Known transverse feeders generally operate according to the Dolfini method described in U.S. Pat. No. 3,661,379. According to this method, the signatures, initially packed inside a feedbox, are successively withdrawn from the same and fed, equally spaced with their backs facing rearwards, on to a grip type conveyor on which they are fed in a direction perpendicular to the backs, and successively engaged by a number of suction heads mounted for rotation about fixed shafts extending transversely in relation to the travelling direction of the conveyor. A first suction head engages the outer surface of the top sheet of the signature, which, by virtue of combined upward rotation of the suction head and forward travel of the signature, is raised so as to at least partially uncover the bottom sheet (if any) of the top half of the signature, which bottom sheet is then engaged by the next rotary suction head. In actual practice, pending engagement of the next sheet by a respective rotary suction head, each sheet may be maintained in the raised position by a retractable supporting plate. The combined action of the suction heads and respective retractable supporting plates provides for parting the two halves of the signature, which, at a curved end portion of the grip conveyor, is gripped along the front edge of the bottom half, and transferred, so parted, on to the fixed saddle of the sewing machine input conveyor.

Signature feeders operating according to the Dolfini method present a number of drawbacks, which are manifested in direct proportion to the operating speed of the sewing machine. On such feeders, in fact, the signatures on the grip conveyor are aligned perpendicular to the backs and relatively far apart, due to the grip spacing on the conveyor being greater than the maximum signature width feedable on to the sewing machine. Said grip spacing, which is unavoidable for preventing even partial overlapping of the signatures, and so ensuring efficient operation of the rotary suction heads, results in relatively high operating speed of the grip conveyor, and in suction head-signature sheet engagement times inversely proportional to the operating speed of the sewing machine. Moreover, high-speed signature feed involves serious difficulties as regards operation of the retractable supporting plates, each of which has to engage the signatures as soon as a respective sheet is raised by a respective suction head, and then withdraw fast enough to prevent tearing the back of the signature.

For sewing machines operating over a given speed, therefore, the reliability of known transverse feeders of the aforementioned type becomes unacceptable, in addition to the possibility of the signatures being damaged during the parting operation.

SUMMARY OF THE INVENTION

The aim of the present invention is to provide a method enabling signatures to be fed transversely on to the input conveyor of a sewing machine, and which provides for overcoming the aforementioned drawbacks.

With this aim in view, according to the present invention, there is provided a method for feeding signatures on to a sewing machine, characterised by the fact that it comprises stages consisting in:

(a) successively feeding said signatures on to a conveyor, with the backs facing rearwards; said signatures comprising a top and bottom half, each consisting of at least two sheets, and being fed on to said conveyor at such a rate that the distance between the backs of two adjacent said signatures is less than the maximum signature width feedable on to said sewing machine;

(b) successively conveying said signatures, at a first given speed, past a number of suction devices and along said conveyor in a first oblique direction in relation to said backs, and in such a manner as to form, on said conveyor, a stream of signatures wherein each sheet of each said signature presents a front corner projecting laterally outwards of said stream in relation to the preceding adjacent signature in said first direction;

(c) parting said signatures by folding back said front corner of each said sheet of at least one half of each said signature, via successive engagement of said corners by respective suction devices aligned and moving reciprocatingly in said first travelling direction, so as to accompany said signatures during engagement of the respective said sheets;

(d) releasing each folded-back sheet on to a respective fixed supporting plate located off said conveyor and extending in said first travelling direction; and (e) successively transferring said parted signatures from said conveyor on to a fixed saddle extending in a second direction substantially transversal to said first direction; such transfer being effected by feeding said parted signatures in said first direction and at a second given speed greater than the first one.

According to the above method, the signatures fed along the conveyor are so spaced that, in most cases, they partially overlap. The distance between the backs of adjacent signatures is thus far less than on the aforementioned known types of feed devices, so that the speed at which the signatures are fed along the conveyor may be reduced accordingly for a given sewing machine operating speed.

Consequently, the length of time said suction devices engage the respective sheets of each signature is increased in direction proportion to the reduction in signature travelling speed. Moreover, engagement between the suction devices and respective sheets may be further improved by enabling reciprocating motion of said devices in the signature travelling direction. In fact, by virtue of the relatively small distance between the backs of adjacent signatures, and the relatively slow speed at which the signatures are fed along the conveyor, the suction devices may be designed, with no substantial mechanical difficulties, to travel along with the respective sheets at said first speed; to engage the respective sheets and release the same on to the respective fixed supporting plates; and to move back rapidly to engage the respective sheets of the next signatures.

An important feature of the above method is that the signatures travelling obliquely along the conveyor are offset transversely, so that the signature corner engaged by the suction devices and supporting plates projects laterally from the oblique stream of signatures formed on the conveyor. Consequently, the supporting plates, which also extend obliquely, may be formed in such a manner as to only engage the projecting corners, and in no way interfere with the backs of the signatures. As such, said supporting plates may be fixed instead of retractable as on the aforementioned known types of feed devices.

According to the present invention, there is also provided a device for feeding signatures on to a sewing machine, said device comprising a signature conveyor; first feeding means for successively feeding said signatures on to said conveyor, with the backs facing rearwards, said signatures comprising a top and bottom half, each consisting of at least two sheets; conveying means for successively conveying said signatures along said conveyor in a first direction and towards the output end of said conveyor; suction means for successively parting the two halves of said signatures as they travel along said conveyor, said suction means comprising at least two suction devices located along said conveyor in said first direction and along the path travelled by said signatures, and at least one signature sheet supporting plate for each suction device; second feeding means for successively withdrawing said parted signatures off the output end of said conveyor, and transferring the same on to a fixed saddle extending in a second direction substantially transversal to said first direction; characterised by the fact that said first direction along said conveyor is oblique in relation to the backs of said signatures, said conveying means being designed to engage said signatures and convey the same in said first direction at a first given speed, and comprising retaining means for ensuring said signatures on said conveyor are arranged in such a manner that the distance between the backs is less than the maximum signature width feedable on to said sewing machine; by the fact that said supporting plates are fixed; and by the fact that said second feeding means comprise an accelerating device designed to engage said parted signatures and convey the same in said first direction at a second given speed greater than said first speed; first actuating means being provided for enabling each said suction device to move reciprocatingly in said first direction, to and from the respective said supporting plate, said first actuating means being designed to enable forward travel of said suction devices at said first speed; and second actuating means being provided for moving said suction devices to and from a position wherein they engage the respective said sheets.

BRIEF DESCRIPTION OF THE DRAWINGS

A non-limiting embodiment of the present invention will be described by way of example with reference to the accompanying drawings, in which.

Figure 1:
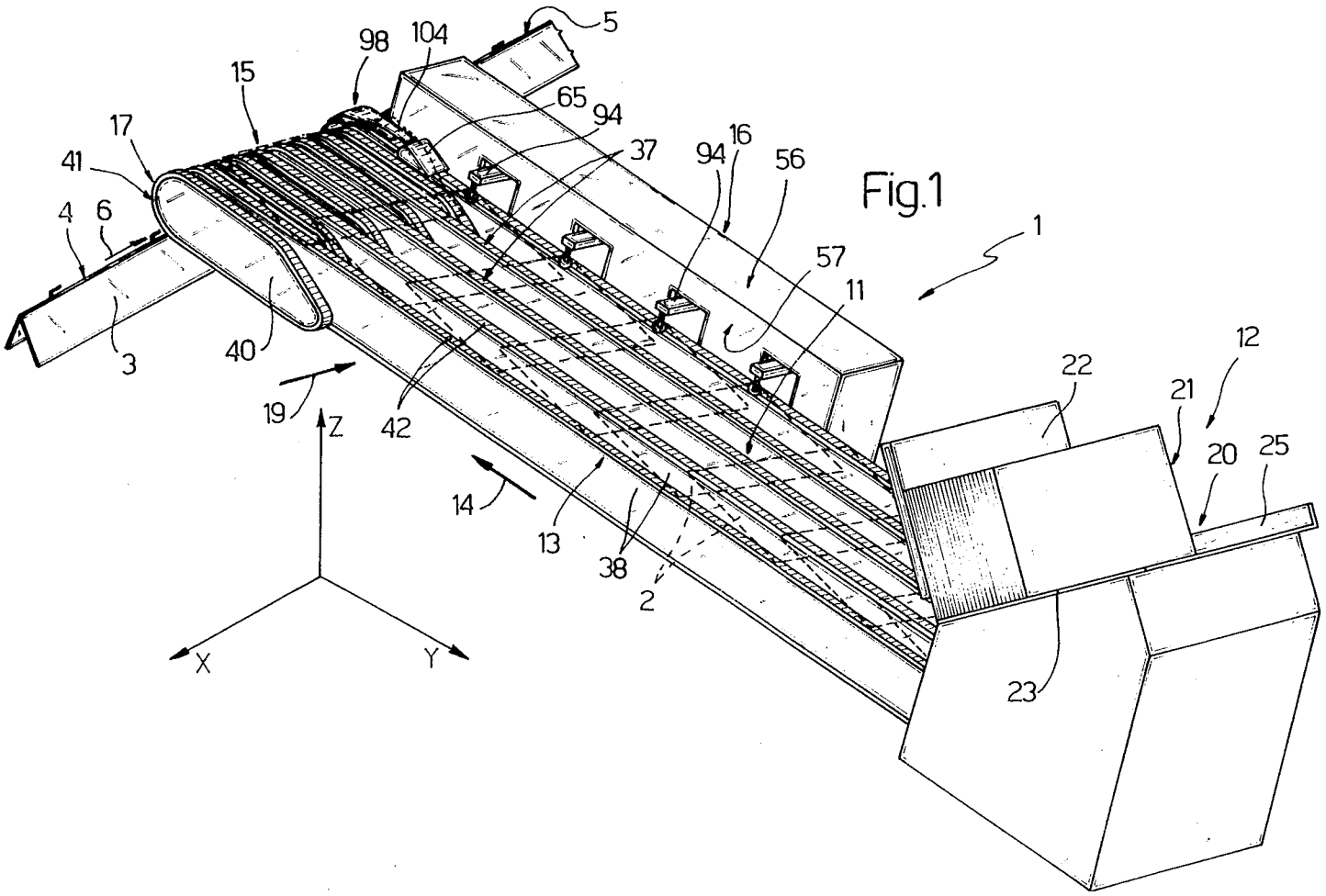
FIG. 1 shows a schematic view in perspective, with parts removed for simplicity, of a preferred embodiment of the feeder according to the present invention.
Figure 2:
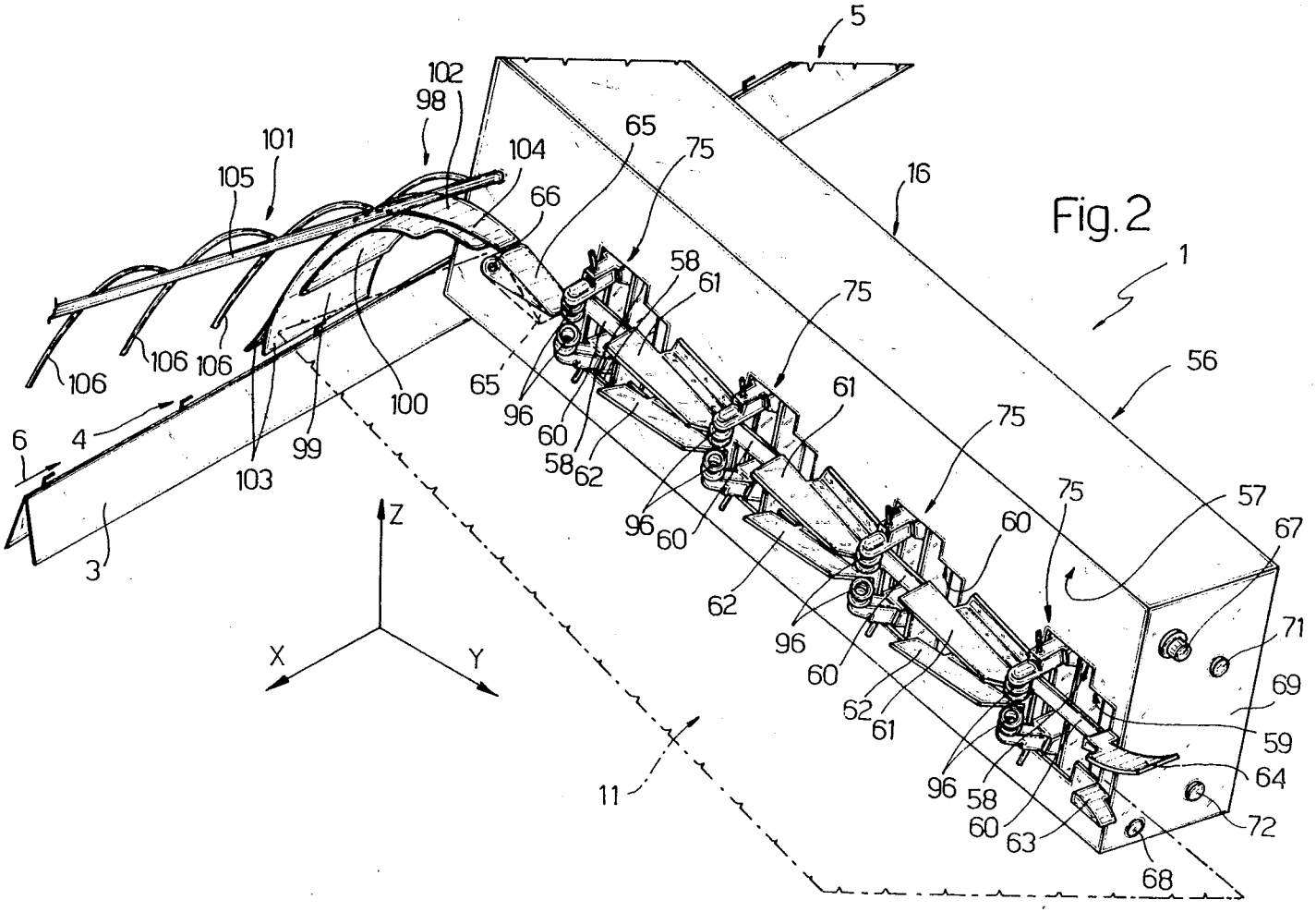
FIG. 2 shows a larger-scale view in perspective of a detail in FIG. 1.
Figure 7:
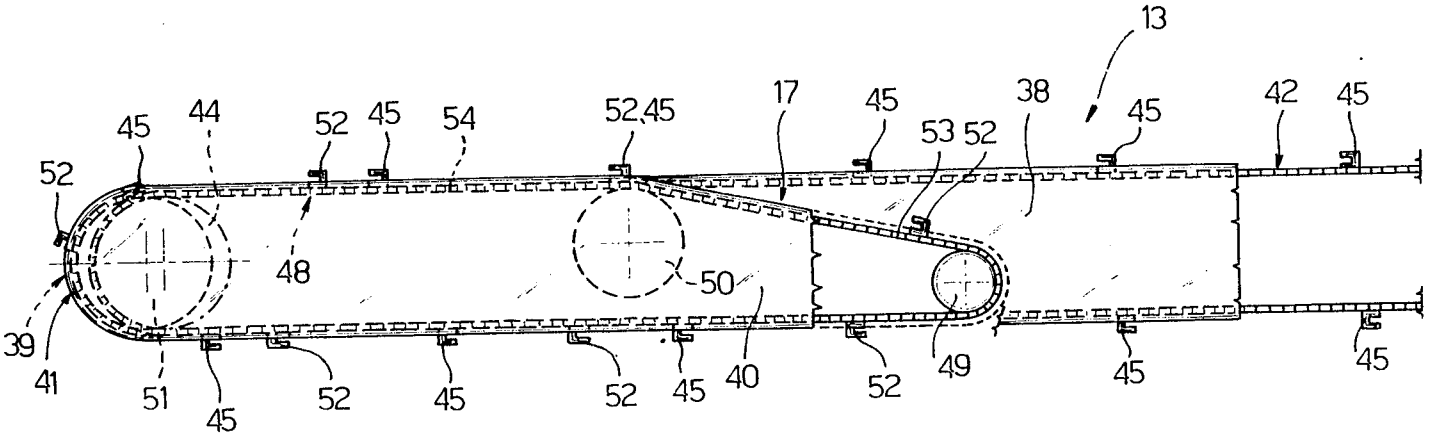
Figure 8:
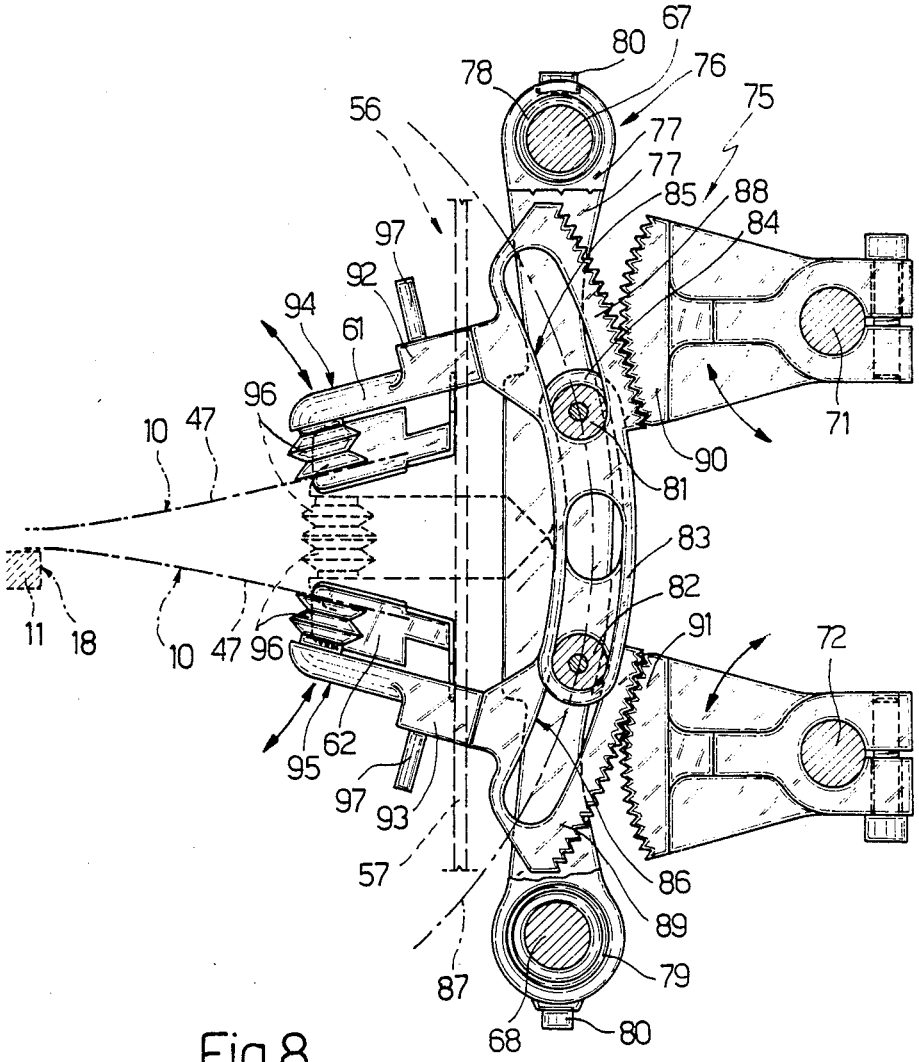
Figure 9:
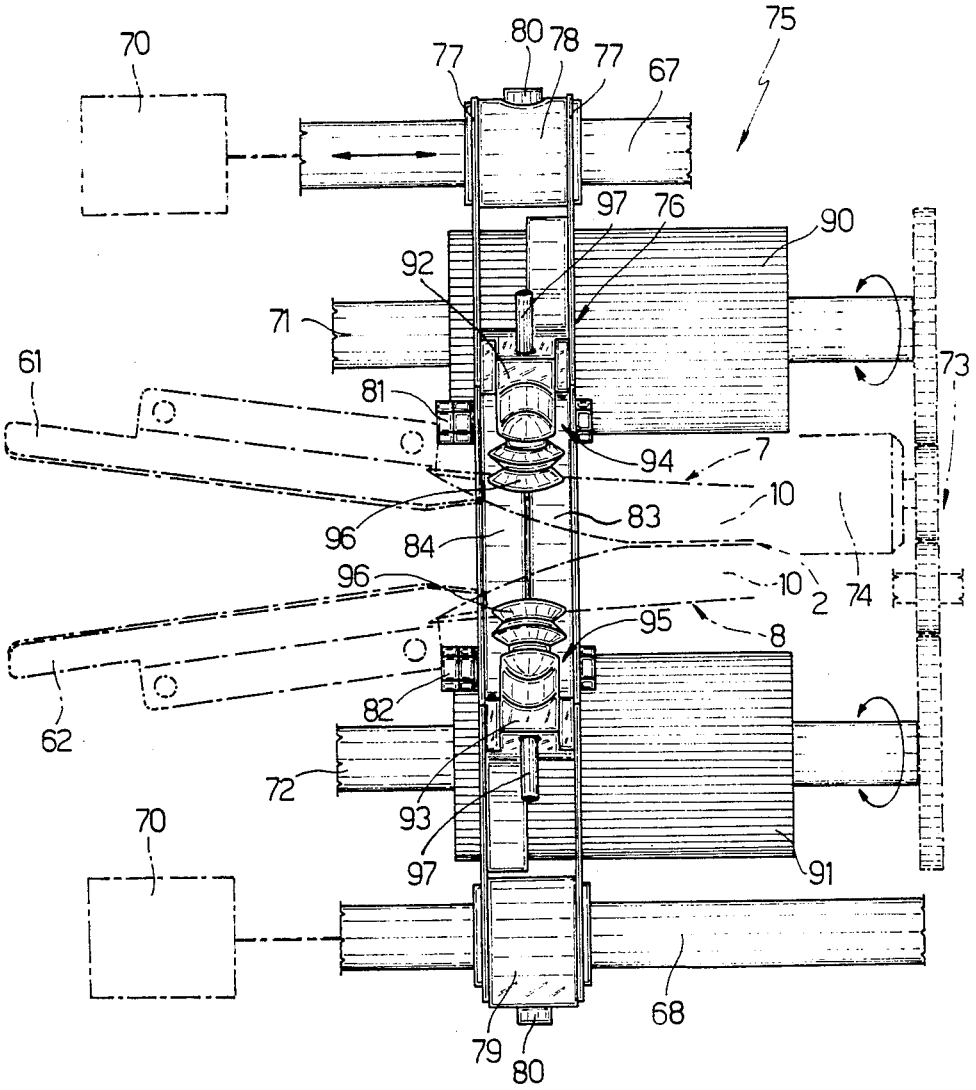
Figure 10:
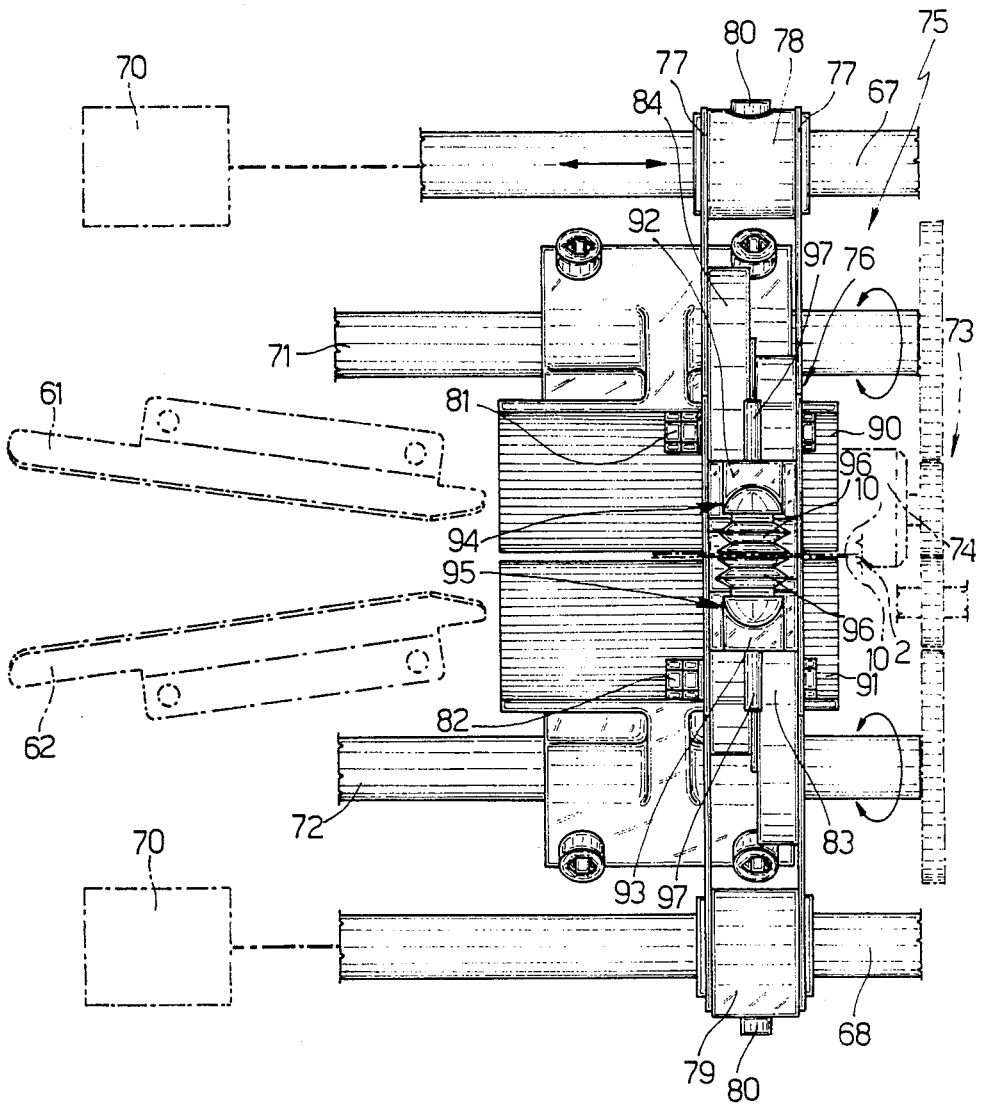
Figure 11:
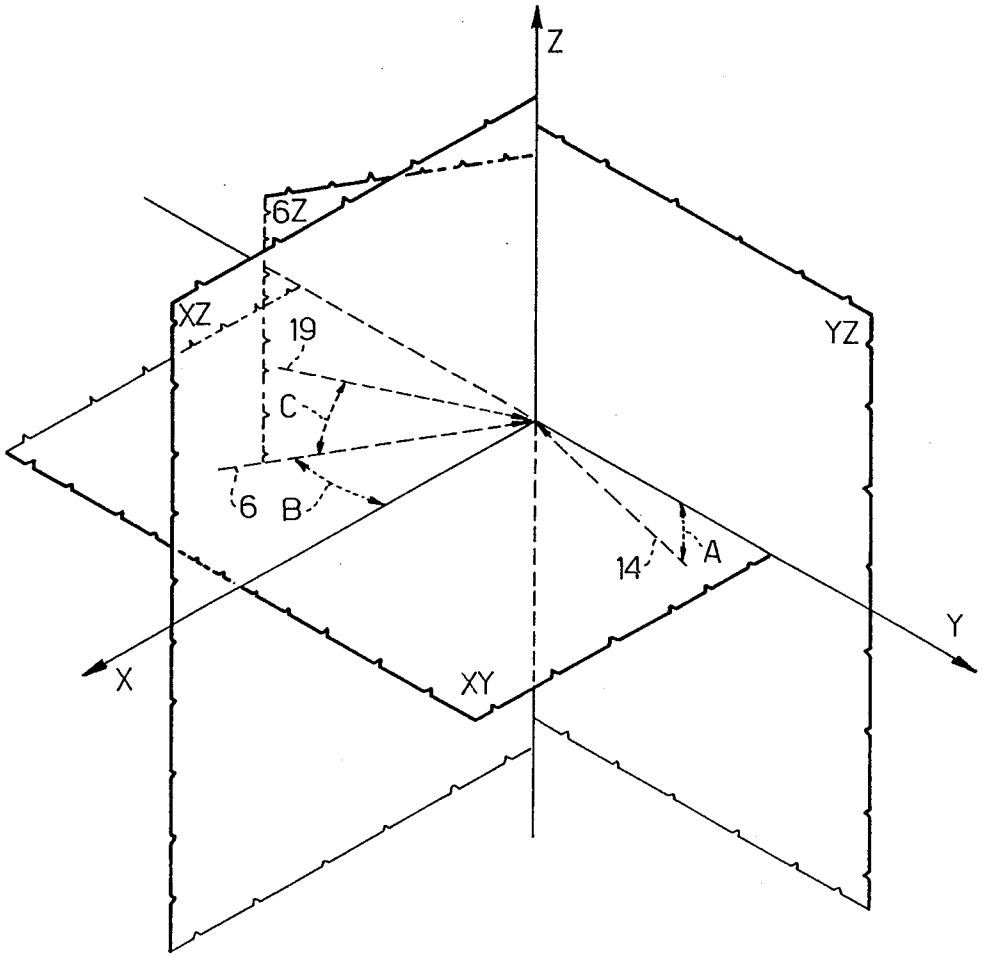

FIGS. *6a* and *6b* show schematic side views, with parts removed for simplicity, of a further detail in FIG. 1 in two different operating position;

FIG. 7 shows a side view, with parts removed for simplicity, of a further detail in FIG. 1;

FIG. 8 shows a larger-scale cross section, with parts removed for simplicity, of a detail in FIG. 2;

FIG. 9 shows a front view of the FIG. 8 detail;

FIG. 10 shows a front view of the FIG. 8 detail in a different operating position;

FIG. 11 shows a cartesian diagram indicating the location in space of the FIG. 1 device.

DETAILED DESCRIPTION OF THE INVENTION

Figure 3:
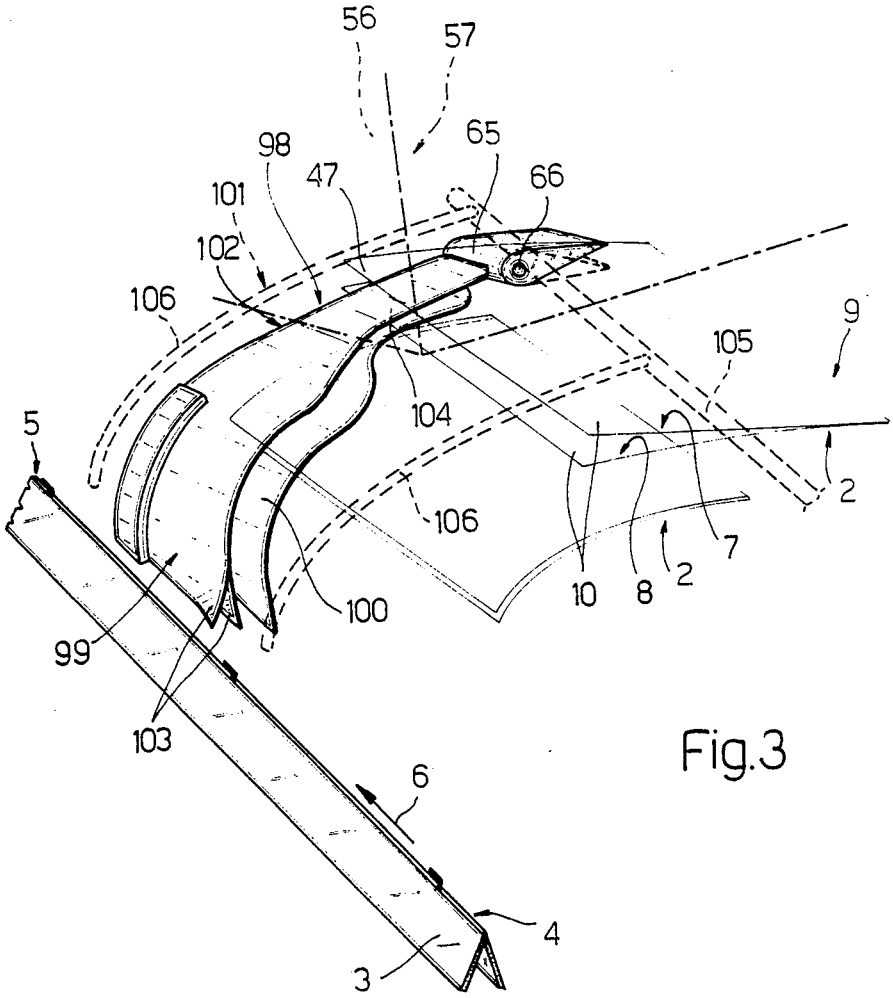
FIG. 3 shows a larger-scale view in perspective of a further detail in FIG. 1.

Number 1 in FIG. 1 indicates a transverse feeder for feeding signatures 2 on to a fixed horizontal saddle 3 of a known type of conveyor 4 constituting the input conveyor of a sewing machine 5, and designed to successively feed signatures 2 on saddle 3 to said machine 5 in a horizontal direction 6 parallel to saddle 3 and lying in horizontal reference plane XY (FIG. 11). As shown, particularly in FIG. 3, each signature 2 comprises a top half 7 and a bottom half 8 folded about a back 9 and each consisting of a number of sheets 10 (only one of which is shown in FIG. 3).

With reference to FIG. 1, device 1 comprises a conveyor 11 for signatures 2; an input assembly 12 for successively feeding signatures 2 on to conveyor 11 with backs 9 facing rearwards; a conveyor 13 for successively conveying signatures 2 along conveyor 11 in a travelling direction 14 lying in vertical reference plane YZ (FIG. 11) and sloping by angle A in relation to plane XY and towards the output end 15 of conveyor 11; a device 16 for successively parting the two halves of signatures 2 as they travel along conveyor 11 in direction 14; and an accelerating or output assembly 17 for successively withdrawing parted signatures 2 off conveyor 13 and transferring the same on to fixed saddle 3.

Parting device 16 extends along a side edge 18 (FIG. 8) of conveyor 11, parallel to direction 14. As shown more clearly in FIG. 5, and particularly in the cartesian diagram in FIG. 11, direction 14 is oblique in relation to direction 6, and the back 9 of each signature 2 travelling along conveyor 11 is maintained parallel to a vertical plane 6Z parallel to direction 6. When projected on to a horizontal plane, direction 6 and backs 9 preferably form an angle B of approximately 20° with the perpendicular to direction 14.

Figure 4:
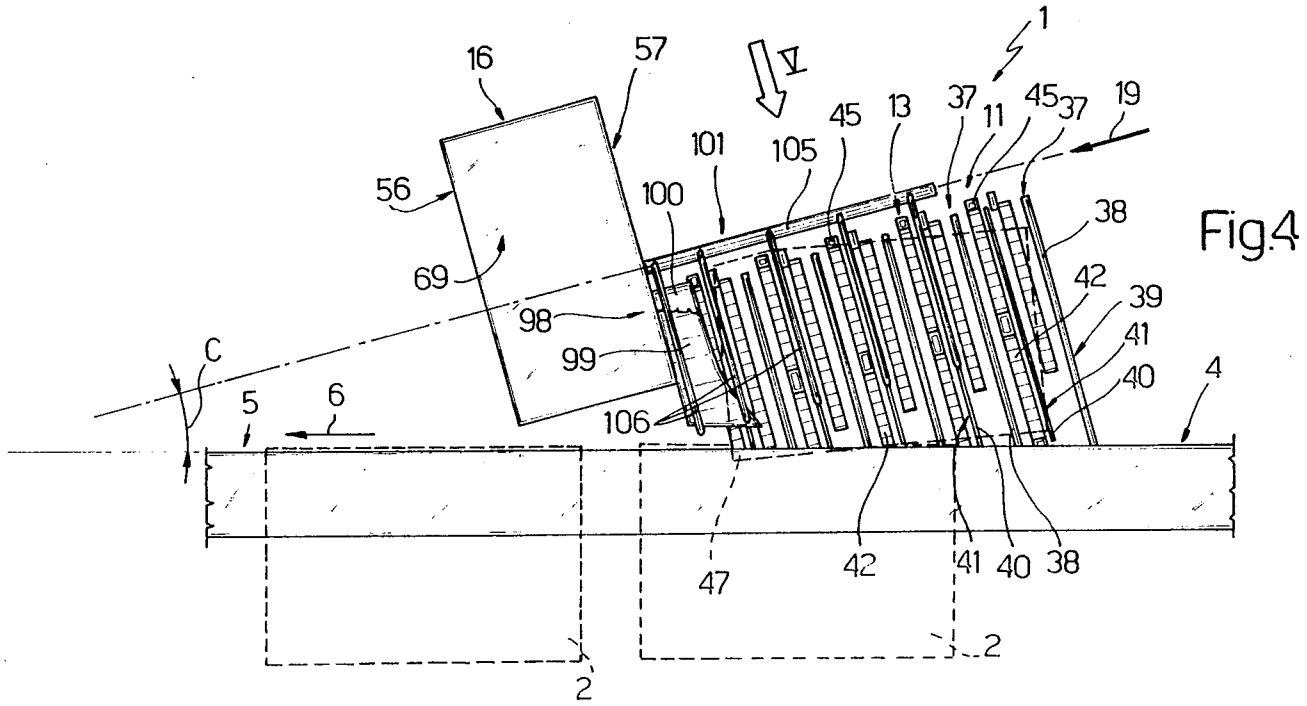
FIG. 4 shows a front view of the FIG. 2 detail.

As shown more clearly in FIGS. 1, 4 and 11, conveyor 11 and feed assembly 12 slope downwards with parting device 16 in direction 6 and transversely in relation to direction 14. When viewed frontally as in FIG. 4, i.e. along a perpendicular to plane 6Z in FIG. 11, conveyor 11 and direction 6 preferably form an angle C of approximately 15°.

Figure 6:
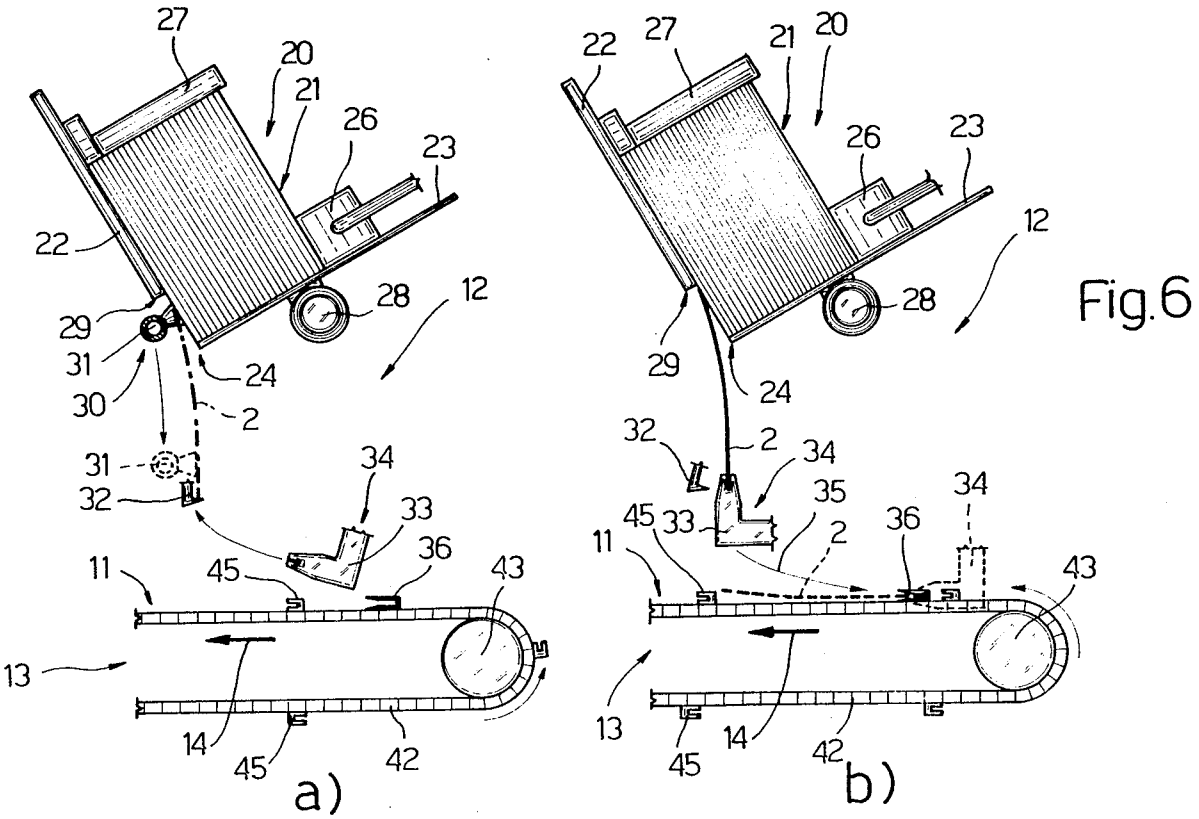

In other words, back 9 of each signature 2 travelling along conveyor 11 in direction 14 is arranged as shown by arrow 19 parallel to vertical plane 6Z, and forms with direction 6, in said vertical plane 6Z, said angle C preferably of about 15°, with its apex facing in direction 6. Moreover, vertical plane 6Z and the perpendicular to direction 14 form an acute angle B preferably of about 20°, with its apex facing in direction 6. As shown in FIG. 6, feed assembly 12 comprises a feedbox 20 designed to receive a lot 21 of signatures 2, and defined by a front plate 22 and a rear plate 23 arranged substantially in the form of a V and connected along their respective bottom edges, so as to define an edge 24 sloping downwards in the direction of arrow 19. The sloping dihedral defined by plates 22 and 23 is closed at the bottom axial end by a shoulder 25 (FIG. 1) perpendicular to plates 22 and 23 and designed to transversely support lot 21. This is arranged with signatures 2 parallel to plate 22 and backs 9 facing downwards and contacting plate 23. Lot 21 is maintained contacting plates 22 and 23 by means of a flexible pressure element 26 and a roller 27 respectively.

Plate 23 is fitted underneath with a known vibratory device 28 which, by virtue of edge 24 sloping downwards and towards shoulder 25, provides for compacting signatures 2 in lot 1, not only towards plate 22, but also towards shoulder 25, thus ensuring perfect alignment. The bottom end of plate 22 presents an opening 29 through which signatures 2 are successively engaged, in the vicinity of back 9, by a first swinging transfer element 30 fitted with suckers 31. These detach back 9 of each signature 2 from plate 23, withdraw signature 2 downwards (FIG. 6*a*), and feed it, with back 9 facing frontwards, on to a swing support 32 from which it is subsequently withdrawn by grips 33 of a second swinging transfer element 34.

Grips 33 (only one of which is shown in FIG. 6) are arranged in a straight line parallel to arrow 19, and provide for gripping back 9 of each signature 2, and transferring this in the direction of arrow 35 (FIG. 6*b*), and in substantially the opposite direction to direction 14, on to conveyor 11 with back 9 facing rearwards and contacting a fixed stop 36 extending parallel to arrow 19, i.e. in the correct position for conveyance along conveyor 11 in direction 14.

As shown in FIG. 1, conveyor 11 is defined by the top edges 37 of a number of substantially rectangular plates 38 perpendicular to conveyor 11 and having their respective longer axes parallel to direction 14. Each plate 38 presents a rear end behind stop 36, and terminates at the front in a curved edge 39 tangent to vertical plane 6Z through saddle 3. The portion of conveyor 11 closest to saddle 3 is defined by the top edges of a further number of plates 40, each parallel to plates 38, located between two adjacent plates 38, and terminating in a curved front edge 41 tangent to vertical plane 6Z.

Figure 5:
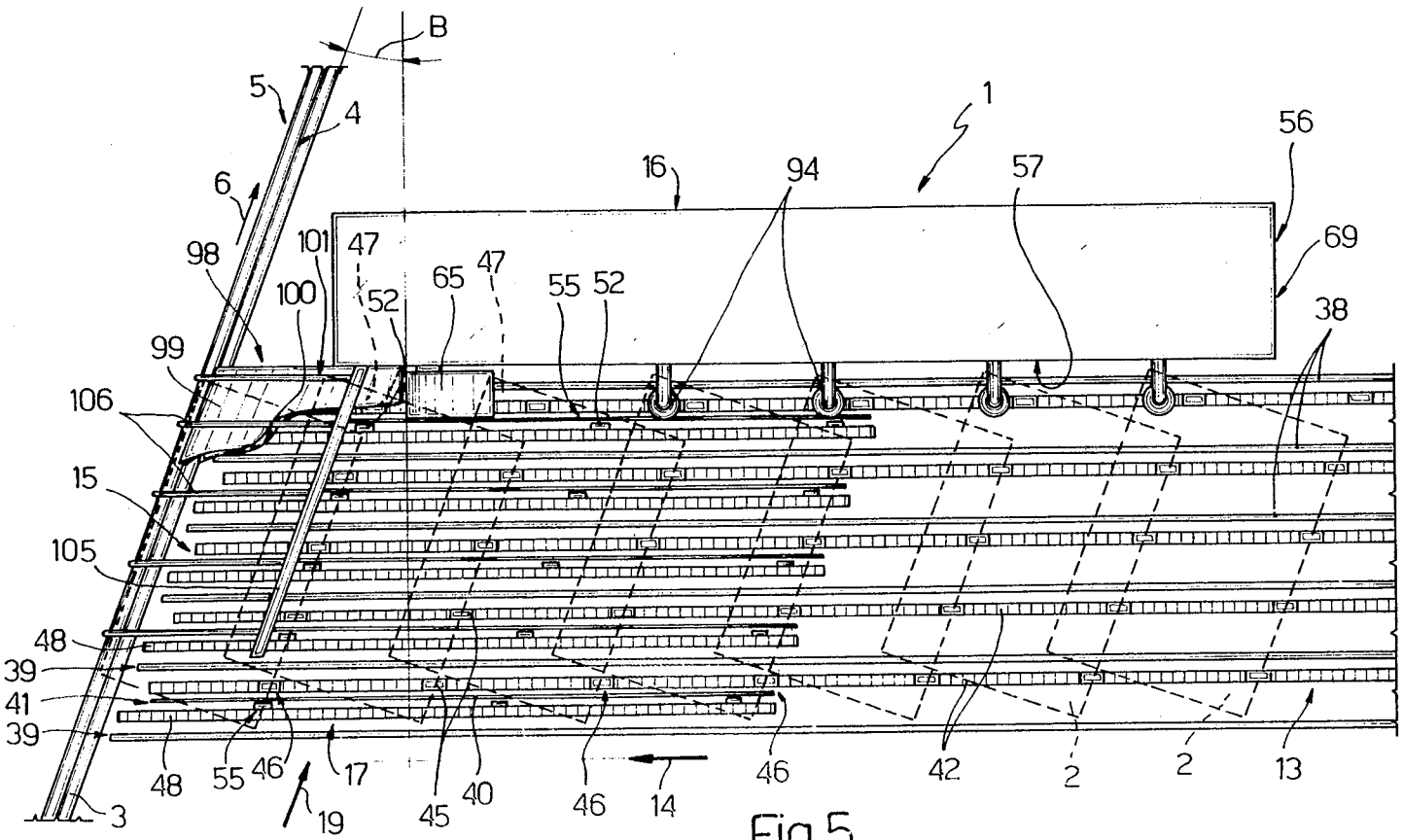
FIG. 5 shows a partial view of the FIG. 1 device in the direction of arrow V in FIG. 4.

As shown, particularly in FIGS. 4, 5 and 7, conveyor 13 comprises a number of chains 42 lying in respective planes parallel to plates 38, and each located between two adjacent plates 38. Each chain 42 is looped about a rear toothed pulley 43 (FIG. 6) supported on a respective plate 38 and situated behind stop 36, and a front toothed pulley 44 (FIG. 7) supported on the same plate 38 and an adjacent plate 40, and located with its outer rim set back in relation to the curved edge 41 of respective plate 40.

Each chain 42 presents a number of equally-spaced grips 45, and runs with its top branch just below conveyor 11, so that grips 45 on said top branch travel along conveyor 11 in direction 14, but are set back in relation to curved edges 41 of respective plates 40 as they travel over the rims of respective pulleys 44.

Grips 45 are spaced along chains 42 so that each grip 45 on one chain 42 is aligned with those on the other chains 42 to form a row 46 parallel to arrow 19. Chains 42 are run at the same speed, so as to move rows 46 parallel to one another along conveyor 11, and at constant speed in direction 14. As shown in FIG. 6*b*, once past pulleys 43, grips 45 in each row 46 may thus engage simultaneously the back 9 of a given signature 2 resting against stop 36, and convey the same towards saddle 3 with back 9 maintained parallel to arrow 19.

By virtue of direction 14 sloping by angle B in relation to the perpendicular to backs 9, signatures 2 travel obliquely along conveyor 11, and are offset transversely with a front corner 47 (the front right-hand corner in the example shown) of each signature 2 projecting laterally from the oblique stream of signatures 2 formed on conveyor 11, and outwards of oblique lateral edge 18 arranged facing and at a given distance from parting device 16.

In connection with the above, it should be noted that rows 46 are so spaced along conveyor 11 that signatures 2 are conveyed successively along the same with backs 9 separated, in direction 14, by a distance of less than the maximum signature width feedable on to sewing machine 5. Consequently, when the distance between the backs 9 of two adjacent signatures 2 is less than the actual width of signtures 2, as in the FIG. 1 example, signatures 2 are arranged partially overlapping on conveyor 11.

As shown, particularly in FIGS. 4 and 5, each plate 40 divides the space between two adjacent plates 38 into two parts, one occupied by chain 42, and the other by a further chain 48 which, together with the other chains 48, defines accelerating assembly 17.

As shown, particularly in FIG. 7, each chain 48 is shorter than the adjacent chain 42, and is looped about a rear toothed pulley 49, a middle toothed pulley 50, and a front toothed pulley 51 located close to the curved front edge 41 of respective plate 40, and supported between respective plates 38 and 40 in a slightly forward position in relation to respective front pulley 44 of adjacent chain 42.

Each chain 48 presents a number of equally-spaced grips 52, and a top branch comprising a sloping rear portion 53 extending substantially beneath conveyor 11 between rear pulley 49 and middle pulley 50, and a front portion 54 extending parallel to and just below conveyor 11 between middle pulley 50 and front pulley 51. Grips 52 along the top branch of each chain 48 thus travel underneath and then along the top of conveyor 11 in direction 14. Moreover, by virtue of the forward position of front pulleys 51 of chains 48, grips 52 travel about the curved edge 41 of respective plates 40, whereas grips 45 of adjacent chains 42 remain set back in relation to curved edges 41, as already stated.

Grips 52 on chains 48 are spaced further apart than grips 45 on chains 42, and are arranged in such a manner that each grip 52 on one chain 48 is aligned with those on the other chains 48 to form a row 55 parallel to arrow 19. Chains 48 are run faster than chains 42, and are so controlled that each row 55 reaches the rear end of front portion 54 of the top branch of chains 48 in time with a respective row 46.

As shown, particularly in FIG. 1, parting device 16 comprises a casing 56 substantially in the form of a rectangular parallelepipedon with its longer axis parallel to direction 14, and having a longer side wall 57 facing and parallel to edge 18 of conveyor 11, and extending in a plane perpendicular to conveyor 11. Through wall 57 there are formed a number of pairs of superimposed openings 58 arranged in two rows extending respectively along the top and underneath conveyor 11. Openings 58 in each said row are equally spaced in direction 14, and are equal in number to the maximum number of sheets 10 in each half 7 and 8 of signatures 2 (in the example shown, each row presents four openings 58). In a portion of the lateral edge of each opening 58 facing feed assembly 12, there is formed a second opening 59 smaller in height than respective opening 58. Between each top and bottom pair of openings 58 and 59, there is provided a dividing wall 60 lying in the same plane as conveyor 11.

Between adjacent top and bottom groups of openings 58 and 59, wall 57 supports two fixed plates 61 and 62 respectively located over and underneath respective dividing wall 60. Plates 61 and 62 extend perpendicular to wall 57 in the direction of edge 18, and the front ends facing saddle 3 diverge and are located in front of the next opening 59. To the rear of the rearmost group of openings 58 and 59, i.e. adjacent to feed assembly 12, wall 57 supports two fixed lead-in plates 63 and 64 located underneath and over conveyor 11 respectively. To the front of the frontmost group of openings 58 and 59, i.e. closest to saddle 3, wall 57 supports a substantially wedge-shaped plate 65 fitted on to a powered shaft 66 so as to oscillate with the same between a first lowered position (shown by the dotted line in FIG. 3) wherein the tip of plate 65 is located just below conveyor 11, and a second raised position (shown by the continuous line in FIG. 3) wherein the rear tip of plate 65 is located just over conveyor 11.

As shown in FIGS. 8 and 9, a first pair of shafts 67 and 68 is mounted inside casing 56, parallel and adjacent to the inner surface of wall 57, shaft 67 being located over shaft 68, and both supported in sliding manner on end walls 69 of casing 56. Shafts 67 and 68 are connected to an actuating device 70 designed to move shafts 67 and 68 back and forth axially by a distance substantially equal to the extension of a pair of openings 58 and 59 in direction 14.

A second pair of shafts 71 and 72 is also mounted inside casing 56, parallel to wall 57, shaft 71 being located over 72, and both being located on the opposite side to shafts 67 and 68 in relation to wall 57, and supported in rotary manner on end walls 69 of casing 56. Shafts 71 and 72 are connected, via a gear drive 73, to an actuating device 74 designed to turn shafts 71 and 72 back and forth in opposite directions about their respective axes.

Each group of openings 58 and 59 is assigned a suction assembly 75 comprising a guide element consisting of a casing 76 defined by. two plates 77 extending between shafts 67 and 68 and lying in planes perpendicular to direction 14. Plates 77 are connected to each other at opposite ends by means of two bushes 78 and 79 fitted through respectively with shafts 67 and 68 and locked both axially and angularly to the same via radial pins 80. Plates 77 are connected centrally to each other by means of two cylindrical pins 81 and 82 located one over the other and extending parallel to direction 14.

Each suction assembly 76 also comprises two slide elements consisting of two plates 83 and 84 arranged partially overlapping between plates 77, and each in the form of a sector. Plates 83 and 84 present respective openings 85 and 86, both fitted through with pins 81 and 82 and extending over arcs of the same circle 87 lying in a plane perpendicular to direction 14 and the center of which is approximately a point on edge 18 of conveyor 11.

The top and bottom ends respectively of plates 83 and 84 present a respective lateral edge facing the opposite way to wall 57; and respective sector gears 88 and 89 concentric with circle 87 and having cylindrical teeth meshing with respective sector gears 90 and 91. Gears 90 and 91 are fitted respectively on to shafts 71 and 72 and, as shown in FIG. 9, each present an axial length greater than the axial travel of shafts 67 and 68.

On the opposite side to, and on a level with respective gears 88 and 89, plates 83 and 84 present respective appendixes 92 and 93 extending in the plane of, and radially in relation to circle 87, and each engaging a respective pair of openings 58 and 59. The free ends of appendixes 92 and 93 are fitted with respective suction heads 94 and 95 having respective suckers 96. Head 94 is located over and facing head 95, and both are connected to a suction source (not shown) via respective pipes 97.

As shown, particularly in FIGS. 3 and 4, wall 57 of casing 56 supports, to the front of plate 65, a guide device 98 comprising a fixed curved plate 99 located midway between a curved bottom plate 100 and a curved top cage 101. The generating lines of plate 99 slope in the direction of arrow 19, and plate 100 and cage 101 substantially reproduce the contour of plate 99, and are located a given distance from the same, so as to define, with plate 99, two curved openings of given width.

Plate 99 is approximately as wide as plates 61 and 62, and presents a top end 102 tangent to the output end 15 of conveyor 11. The bottom end of plate 99 is arranged facing and in line with the apex of saddle 3, and presents two diverging wings 103 sloping down on opposite sides of saddle 3. Curved plate 100 is as wide as plate 99, and comprises a tapered top portion 104 extending beneath conveyor 11 from a point just in front of plate 65. As shown in FIG. 5, cage 101 comprises a transverse rod 105 connected integral with wall 57 and extending from the same, parallel with arrow 19, over conveyor 11 and portion 104 of plate 100; and a number of curved longitudinal rods 106 extending downwards, beyond the apex of saddle 3, from equallyspaced points on rod 105.

In actual use, signatures 2 are withdrawn successively from lot 21 inside feedbox 20, and fed on to conveyor 11 contacting fixed stop 36 and with backs 9 arranged parallel to arrow 19, so as to enable each signature 2 to be gripped by a respective row 46 of grips 45 and fed along conveyor 11 in direction 14.

As already stated, signatures 2 in the stream formed along conveyor 11 are offset laterally in relation to one another, each signature 2 presenting a front edge projecting laterally in the direction of parting device 16 and in relation to the lateral edge of the preceding signature 2, and a front corner 47 projecting beyond the bottom lateral edge 18 of conveyor 11 and travelling in direction 14 with its apex substantially contacting the outer surface of wall 57.

As it travels along conveyor 11, front corner 47 of each signature 2 is successively engaged by heads 94 and 95, which provide for parting sheets 10 of the top half 7 or bottom half 8 of signature 2.

The following is a detailed description of the various stages involved for parting sheets 10 of both top and bottom halves 7, 8 of each signature 2 travelling along conveyor 11; which stages are repeated for each signature 2.

In connection with the above, it should be pointed out that, in actual use, heads 94 or 95 are usually disabled for parting sheets 10 of only one half 7 or 8 of signature 2.

The stages referred to in the following description may be timed by mechanically synchronizing conveyor 13 and actuators 70 and 74 (in known manner not shown) or by controlling actuators 70 and 74 by means of known sensors (not shown) for determining the position of signatures 2 on conveyor 11.

When the apex of front corner 47 of signatures 2 reaches the rear end of the rearmost group of openings 58 and 59, the suction assembly 75 of said group of openings is located substantially in the rearmost axial position, wherein appendixes 92 and 93 engage respective openings 59; plate 83 presents the top end of opening 85 almost contacting pin 81; and plate 84 presents the bottom end of opening 86 almost contacting pin 82. With plates 83 and 84 so positioned, suction heads 94 and 95 are arranged facing one another, with sufficient clearance to enable the passage of corner 47 of folded signature 2 between suckers 96.

At this point, actuators 70 move shafts 67 and 68 forward in direction 14 at the same speed as conveyor 13, and, at the same time, actuator 74 is operated for turning gears 90 and 91 towards each other.

Operation of actuators 70 and 74 as described above causes gears 88 and 89 to slide axially along respective gears 90 and 91, and plates 83 and 84, and consequently also heads 94 and 95, to move towards each other into the FIG. 10 position, wherein suckers 96 on heads 94 and 95 engage corner 47 of respective top and bottom sheets 10 of signature 2.

Simultaneous operation of the suction source (not shown) connected to pipes 97 results in adhesion of suckers 96 on heads 94 and 95 to respective sheets 10.

At this point, with no change in displacement of shafts 67 and 68 in direction 14, actuator 74 is reversed so as to move gears 90 and 91 away from each other and into the position shown in FIGS. 8 and 9. This causes heads 94 and 95 to part, still sloping towards each other and in a radial position in relation to circle 87, so as to part corners 47 of respective sheets 10 and deposit the same on to respective fixed plates 61 and 62.

At this point, corners 47 so parted may be released from heads 94 and 95, by cutting off suction along pipes 97, and fed forward by conveyor 13 in direction 14, contacting respective plates 61 and 62. At the same time, actuators 70 and 74 are reversed so as to reset all the suction assemblies 75 to the starting position described previously.

With reference to the suction assembly adjacent to the rearmost suction assembly 75, it will be noted that, in said starting position, heads 94 and 95 are parted slightly inside the gap between the preceding plates 61 and 62, so that the unparted portion of signature 2 travels in direction 14 inside the gap between heads 94 and 95, whereas the two previously parted corners 47 slide over said plates 61 and 62 outside heads 94 and 95.

Subsequent operation of actuators 70 and 74 as already described, combined with forward travel of signature 2 in direction 14, causes said heads 94 and 95 to engage respective corners 47 of the two sheets 10 inside those already parted, said inside sheets 10 then being lifted on to the following plates 61 and 62.

The above operations are repeated for all the inside sheets 10, until the two halves 7 and 8 of signature 2 have been parted; the top half 7 being deposited by head 94 of the frontmost suction assembly 75 on to the upper surface of plate 65.

For parting sheets 10 in top half 7 only, plate 65 is set permanently in the raised position (shown by the continuous line in FIGS. 2 and 3) with its rear apex just over conveyor 11. For parting sheets 10 in bottom half 8 only, plate 65 is set permanently in the lowered position (shown by the dotted line in FIGS. 2 and 3) with its rear apex just below conveyor 11. The following description relates to operation of heads 94 for parting sheets 10 of top half 7.

When, fully parted by front head 94, the corners 47 of sheets 10 in top half 7 of signature 2 slide over front fixed top plate 61 and on to the upper surface of raised plate 65, a row 55 of grips 52 on accelerating device 17 engages back 9 of signature 2, so as to release the same from grips 45 of conveyor 13 and feed it towards saddle 3 along a curved connecting route defined by the curved edges 39 and 41 of plates 38 and 40.

As it travels along said curved connecting route, corner 47 of top half 7 of each signature 2 is gradually released from plate 65, by virtue of direction 14 being oblique in relation to arrow 19, and deposited on to plate 99. Bottom half 8 of signature 2, on the other hand, is deposited on to top end 102 of plate 100, and engages the gap between plate 100 and plate 99. As they are fed towards saddle 3, halves 7 and 8 of signature 2 engage diverging wings 103 of plate 99 by which they are guided correctly on to opposite sides of saddle 3. At the same time, cage 101 prevents top half 7 from being blown backwards as it travels along said curved connecting route.

In connection with the above, it should be pointed out that, by virtue of the downward slope of arrow 19 in relation to direction 6, corner 47 of the transferred signature 2 is the first to reach saddle 3, whereas back 9 travels along a path which, by virtue of the narrow width of plate 99 and the slope of direction 14 in relation to arrow 19, in no way interferes with plate 99. Device 98 therefore provides for positively guiding each parted signature 2 along the entire curved connecting route between conveyor 11 and saddle 3, while diverging wings 103 on plate 99 enable signature 2 to gradually engage saddle 3 correctly parted.

It should be stressed that the operating characteristic enabling signatures 2 to be parted as described above consists in their travelling along conveyor 11 with backs 9 arranged obliquely in relation to wall 57, and front corners 47 projecting in relation to the stream of signatures 2 formed on conveyor 11.

It is this characteristic, in fact, which enables corners 47 of each sheet 10 to move up on to respective plate 61 or 62 and automatically off the same as signature 2 travels along conveyor 11, with no interference between said plate 61 or 62 and back 9, which travels outside the same, thus enabling the use of fixed plates 61 and 62.

The same characteristic also enables the use of suction heads 94 and 95 designed to travel together with signatures 2 in direction 14, as well as in relation to signatures 2 in a plane perpendicular to direction 14; and also a reduction in the distance between backs 9 of adjacent signatures 2, which in turn provides for reducing the speed of conveyor 13, and maximising engagement time of sheets 10 and heads 94 and 95. In fact, by virtue of signatures 2 being arranged obliquely in relation to the moving plane of circle 87 in which suction heads 94 and 95 travel, only corners 47 are displaced in relation to conveyor 11, so that signatures 2 may even overlap as they travel along conveyor 11. As regards suction heads 94 and 95, it should be stressed that, in the majority of cases, top heads 94 are alone sufficient for parting signatures 2, bottom heads 95 being disconnectable by cutting off the suction source (not shown) to pipes 97. Nevertheless, for also parting corners 47 of sheets 10 in bottom half 8 of signature 2, the aforementioned operating characteristic enables this to be done extremely simply, by virtue of said corners 47 projecting beyond edge 18 of conveyor 11 and being readily accessible from underneath.

Finally, it should be noted that suction assemblies 75 are so designed as to enable corners 47 of sheets 10 to be detached from conveyor 11 with no impairment of sheets 10. As shown in FIG. 8, in fact, when parting, suction heads 94 and 95 maintain a radial position in relation to circle 87, thus imparting a natural sweep with no creasing on engaged sheets 10.

Needless to say, should each half 7 and 8 of signature 2 present fewer sheets 10 than the groups of openings 58 and 59 on parting device 16, the suction assemblies 75 not required are disabled by cutting off suction to respective pipes 97.

I claim:

1. A method for feeding signatures (2) on to a sewing machine (5), characterised by the fact that it comprises stages consisting in:

(a) successively feeding said signatures (2) on to a conveyor (11), with the backs (9) facing rearwards; said signatures (2) comprising a top (7) and bottom (8) half, each consisting of at least two sheets (10), and being fed on to said conveyor (11) at such a rate that the distance between the backs (9) of two adjacent said signatures (2) is less than the maximum signature width feedable on to said sewing machine (5);

(b) successively conveying said signatures (2), at a first given speed, past a number of suction devices (75) and along said conveyor (11) in a first oblique direction (14) in relation to said backs (9), and in such a manner as to form, on said conveyor (11), a stream of signatures (2) wherein each sheet (10) of each said signature (2) presents a front corner (47) projecting laterally outwards of said stream in relation to the preceding adjacent signature (2) in said first direction (14);

(c) parting said signatures (2) by folding back said front corner (47) of each said sheet (10) of at least one half (7, 8) of each said signature (2), via successive engagement of said corners (47) by respective suction devices (75) aligned and moving reciprocatingly in said first travelling direction (14), so as to accompany said signatures (2) during engagment of the respective said sheets (10);

(d) releasing each folded-back sheet (10) on to a respective fixed supporting plate (61, 62) located off said conveyor (11) and extending in said first travelling direction (14); and (e) successively transferring said parted signatures (2) from said conveyor (11) on to a fixed saddle (3) extending in a second direction (6) substantially transversal to said first direction (14); such transfer being effected by feeding said parted signatures (2) in said first direction (14) and at a second given speed greater than the first.

2. A method as claimed in claim 1, characterised by the fact that said signatures (2) are fed along said conveyor (11) in such a manner that said corners (47) project in relation to a lateral edge (18) of said conveyor (11) extending parallel to said first travelling direction (14).

3. A method as claimed in claim 2, characterised by the fact that each said suction device (75) comprises at least a suction head (94, 95); said corner (47) of respective said sheet (10) being folded back by engaging said suction head (94, 95) on said corner (47) of said sheet (10) and moving said suction head (94, 95) away from said conveyor (11) in a plane moving with said signatures (2) in said first direction (14) and perpendicular to the same.

4. A method as claimed in claim 3, characterised by the fact that, when travelling in said moving plane, each said suction head (94, 95) is guided in such a manner as to maintain a radial position in relation to a circle (87) lying in said moving plane and having its center approximately on said lateral edge (18) of said conveyor (11).

5. A method as claimed in claim 1, characterised by the fact that it comprises a further stage consisting in maintaining said signatures (2), when travelling along said conveyor (11) and also during transfer from said said conveyor (11) to said fixed saddle (3), in a position wherein each back (9) is arranged in a third direction (19) constantly parallel to a vertical plane parallel to said second direction (6) and sloping downwards, in said vertical plane, in relation to said saddle (3) and in said second direction (6).

6. A method as claimed in claim 5, characterised by the fact that it comprises a further stage consisting in guiding and maintaining parted said front corner (47) of each said signature (2), as each said signature (2) is transferred along a curved connecting route between said conveyor (11) and said saddle (3); and in engaging said corner (47) first on said saddle (3).

7. A device for feeding signatures (2) on to a sewing machine (5), said device comprising a signature conveyor (11); first feeding means (12) for successively feeding said signatures (2) on to said conveyor (11), with the backs (9) facing rearwards, said signatures (2) comprising a top (7) and bottom (8) half, each consisting of at least two sheets (10); conveying means (13) for successively conveying said signatures (2) along said conveyor (11) in a first direction (14) and towards the output end (15) of said conveyor (11); suction means (16) for successively parting the two halves of said signatures (2) as they travel along said conveyor (11), said suction means (16) comprising at least two suction devices (75) located along said conveyor (11) in said first direction (14) and along the path travelled by said signatures (2), and at least one signature sheet supporting plate (61, 62) for each suction device (75); second feeding means (17, 65, 98) for successively withdrawing said parted signatures (2) off said outout end (15) of said conveyor (11), and transferring the same on to a fixed saddle (3) extending in a second direction (6) substantially transversal to said first direction (14); characterised by the fact that said first direction (14) along said conveyor (11) is oblique in relation to the backs (9) of said signatures (2), said conveying means (13) being designed to engage said signatures (2) and convey the same in said first direction (14) at a first given speed, and comprising retaining means (45, 52) for ensuring said signatures (2) on said conveyor (11) are arranged in such a manner that the distance between the backs (9) is less than the maximum signature width feedable on to said sewing machine (5); by the fact that said supporting plates (61, 62) are fixed; and by the fact that said second feeding means (17, 65, 98) comprise an accelerating device (17) designed to engage said parted signatures (2) and convey the same in said first direction (14) at a second given speed greater than said first speed; first actuating means (70) being provided for enabling each said suction device (75) to move reciprocatingly in said first direction (14), to and from the respective said supporting plate (61, 62), said first actuating means (70) being designed to enable forward travel of said suction devices (75) at said first speed; and second actuating means (74) being provided for moving said suction devices (75) to and from a position wherein they engage respective said sheets (10).

8. A device as claimed in claim 7, characterised by the fact that said conveyor (11), said conveying means (13) and said accelerating device (17) are such as to maintain said signatures (2) in a position wherein said back (9) is arranged in a third direction (19) constantly parallel to a vertical plane parallel to said second direction (6), and sloping downwards, in said vertical plane, in relation to said saddle (3) and in said second direction (6); said second feeding means (17, 65, 98) comprising means (65, 98) for guiding and maintaining parted said front corner (47) of each said signature (2), as each said signature (2) is transferred by said accelerating device (17) along a curved connecting route between said conveyor (11) and said saddle (3), and for engaging said corner (47) first on said saddle (3).

9. A device as claimed in claim 7, characterised by the fact that said conveyor (11) presents a lateral edge (18) extending in said first travelling direction (14) and located facing and at a given distance from said suction means (16); said conveying means (13) being designed to convey said signatures (2) in said first direction (14) in a laterally offset position in relation to one another and wherein respective front corners (47) of said sheets (10) project beyond said lateral edge (18) and towards said suction means (16).

10. A device as claimed in claim 9, characterised by the fact that each said suction device (75) comprises a guide element (76) connected to said first actuating means (70) and moved by the same reciprocatingly in said first direction (14), and defining a route (87) extending over an arc of a circle located in a plane perpendicular to said first direction (14) and having its center approximately on said lateral edge (18) of said conveyor (11); at least one slide element (83, 84) mounted in sliding manner on said guide element (76) and connected to said second actuating means (74) and moved by the same reciprocatingly along said circular route (87); and a suction head (94, 95) integral with said slide element (83, 84) and extending radially in relation to said circular route (87) and towards said lateral edge (18) of said conveyor (11) in such a manner as to interfere with said corners (47) of said signatures (2).

11. A device as claimed in claim 10, characterised by the fact that said slide element (83, 84) comprises a first sector gear (88, 89) concentric with said circular route (87); a second sector gear (90, 91) being connected to said first sector gear (88, 89) and being moved by said second actuating means (74) so as to oscillate by a given amount about a shaft (71, 72) perpendicular to said circular route (87).

12. A device as claimed in claim 11, characterised by the fact that said second sector gear (90, 91) is axially fixed in relation to respective said shaft (71, 72); both said sector gears (88, 89)(90, 91) presenting cylindrical teeth, and said second sector gear (90, 91) presenting an axial development of substantially the same length as the travel of said first actuating means (70).

13. A device as claimed in claim 8, characterised by the fact that said conveying means (13) comprise a conveyor defined by a number of looped chains (42) lying in planes parallel to said first direction (14); each said chain (42) presenting a top branch extending parallel to said conveyor (11); said retaining means (45, 52) comprising a number of grips (45) equally spaced along each said chain (42); each said grip (45) combining with respective grips (45) on the other said chains (42) to form a row (46) arranged in said third direction (19); and each said row (46) being designed to move along said conveyor (11) with said top branches of said chains (42), and to engage the back (9) of a respective said signature (2) and feed the same along said conveyor (11) with said respective back (9) maintained parallel to said third direction (19).

14. A device as claimed in claim 13, characterised by the fact that said accelerating device (17) comprises a number of further looped chains (48) lying in planes parallel to said first direction (14); each said further chain (48) presenting a top branch comprising an output portion (54) extending parallel to said conveyor (11); said retaining means (45, 52) comprising a number of further grips (52) equally spaced along each said further chain (48); each said further grip (52) combining with respective further grips (52) on the other said further chains (48) to form a further row (55) arranged in said third direction (19); and each said further row (55) being designed to move along said conveyor (11) with said portions (54) of said top branches of said further chains (48), and to engage the back (9) of a respective said signature (2) and transfer the same from said conveyor (11) to said saddle (3) along said curved connecting route, and with said back (9) maintained parallel to said third direction (19).

15. A device as claimed in claim 14, characterised by the fact that said further rows (55) are designed to travel at said second speed greater than said first speed of said rows (46); said chains (42) and said further chains (48) being synchronized in such a manner that a said further row (55) and a said row (46) are aligned substantially at the beginning of said output portion (54) of said further chains (48).

16. A device as claimed in claim 15, characterised by the fact that it comprises a number of plates (38) parallel to said first direction (14) and located between said chains (42); each said plate (38) presenting a straight lateral edge (37) combining with the respective said edges (37) of the other said plates (38) to define said conveyor (11), and having, on the side facing said saddle (3), a curved end edge (39) substantially tangent to said vertical plane and combining with the respective said curved edges (39) of the other said plates (38) to define said curved connecting route.

17. A device as claimed in claim 8, characterised by the fact that said guide means (65, 98) comprise first mobile guide means (65) located on said conveyor (11) immediately upstream from said curved connecting route, and second fixed guide means (98) located along said curved connecting route; said guide means (65, 98) extending in said third direction (19) in such a manner as to interfere solely with said front corner (47) of said signatures (2).

18. A device as claimed in claim 17, characterised by the fact that said first mobile guide means (65) comprise a wedge-shaped plate having its apex facing in the opposite direction to said first direction (14) and designed to move between a first position, wherein said apex is located over said conveyor (11), and a second position wherein said apex is located beneath said conveyor (11).

19. A device as claimed in claim 17, characterised by the fact that said fixed guide means (98) comprise a fixed curved plate (99) extending along said curved connecting route, and having an input end (102) tangent to said conveyor (11), and an output end facing said saddle (3); said output end being defined by two diverging wings (103) extending towards opposite sides of said saddle (3).

20. A device as claimed in claim 19, characterised by the fact that said fixed guide means (98) also comprise a curved plate (100) and a curved cage (101) located on opposite sides of said fixed curved plate (99); said curved plate (100) being located inside and said curved cage (101) outside said curved connecting route.

21. A device as claimed in claim 7, characterised by the fact that said first feeding means (12) comprise a feedbox (20) for a lot (21) of signatures (2); said feedbox (20) being defined by a front plate (22) and a rear plate (23) connected together to form a dihedral having one edge (24) parallel to said third direction (19).

22. A device as claimed in claim 21, characterised by the fact that said feedbox (20) also comprises a transverse shoulder (25) at the downstream end of said edge (24) in said third direction (19); said lot (21) being arranged with said backs (9) of said signatures (2) contacting said rear plate (23), and vibrating means (28) being connected to said rear plate (23) for compacting said signatures (2) of said lot (21) on said front plate (22) and said transverse shoulder (25).

* * * * *